US006053389A

United States Patent [19]

Chu et al.

[11] Patent Number: 6,053,389

[45] Date of Patent: Apr. 25, 2000

[54] NAILING GUN MAGAZINE SPECIALLY DESIGNED FOR BIG NAIL SET

[75] Inventors: Yue Kin Chu, Chandler, Ariz.; Shi Hom Wang, Taichung Hsien, Taiwan

[73] Assignee: Sup Drogon Enterprise Co., Ltd., Taichung Hsien, Taiwan

[21] Appl. No.: 09/129,637

[22] Filed: Aug. 5, 1998

[51] Int. Cl.[7] ..... B25C 1/04

[52] U.S. Cl. ..... 227/120; 227/119

[58] Field of Search ..... 227/120, 109, 227/119, 136

[56] References Cited

U.S. PATENT DOCUMENTS

| | | | |
|---|---|---|---|
| 5,322,189 | 6/1994 | Oda | 227/120 |
| 5,335,800 | 8/1994 | Liu | 227/120 |
| 5,626,274 | 5/1997 | Shkolnikov et al. | 227/109 |
| 5,632,431 | 5/1997 | Lin | 227/119 |
| 5,695,108 | 12/1997 | Lee | 227/120 |
| 5,816,469 | 10/1998 | Ohuchi | 227/120 |

*Primary Examiner*—Scott A. Smith

[57] ABSTRACT

This invention relates to an improvement configuration of a nailing gun magazine specially designed for a big nail set. An anti-slip nut is used between the nail magazine and muzzle in order to reinforce their fastening strength and prevent them from being loosened. It also uses a π-shaped reinforcement rib on the end face of the nail magazine that is correspondent to work piece. It can achieve better anti-collision ability and is resistant to deformation. Furthermore, a nail pushing segment sliding channel is fitted in the nail magazine. It can fix the coil of a coiled-spring to the end face of this sliding channel in order to locate the coiled spring out of the nail set piercing & loading hole.

5 Claims, 5 Drawing Sheets

NAILING GUN MAGAZINE SPECIALLY DESIGNED FOR BIG NAIL SET

BACKGROUND OF THE INVENTION

1. Field of the Invention

This invention relates to a magazine for a nailing gun specially designed for big nail set. This structure is tightly secured to the muzzle to resist the large reaction force generated while using the nailing gun. It is fitted with a reinforcement rib to prevent the nail magazine from being deformed and damaged. Also, it can ease nail loading without damaging the coiled-spring. It can further assure of that gun's integral working life is maintained.

2. Description of the Prior Art

The nailing gun is particularly utilized in the related operation of woodworking or decoration as a professional tool. The so-called big nail set is defined as a nail set having a size above 3 inches. In other words, this type of nail part is used to nail wood board or other type of board having a certain thickness or above a certain thickness only. A bigger nail must be fitted to a bigger gun (bigger air chamber) having a bigger impact force (thicker firing pin). Otherwise, the nail cannot be totally nailed into the work piece without difficulties. However, since this type of gun has a bigger impact force, this force is proportional to the relative reaction force while the gun is shooting. Because of its bigger size, its integral weight is considerable.

Thus, please refer to FIG. 1 for the schematic drawing to show the structure of nailing gun's magazine that is practically loaded with a big nail set. The assembly method applied to nail magazine 10 and muzzle 11 is to use a threaded hole 13 drilled on fixture 12 at both sides of muzzle 11 and a bolt 14 at each hole to clip and align the clip shim 18 and groove 15 correspondent to nail magazine 10. As mentioned in earlier paragraph, the reaction force generated at muzzle 11 will be very strong while using the gun. It is inevitable that muzzle 11 and nail magazine 10 will become loose after a certain time period of usage. They must be re-fastened before proceeding to the next nailing operation. This will surely create a certain degree of inconvenience and will be criticized by all users.

Furthermore, end face 16 is correspondent to nail magazine 10 and it is inevitable that it will collide with the work piece or surrounding articles at any time during the nailing operation. There is no anti-collision device fitted to nail magazine 10 at this location. Under this circumstance, end face 16 is inclined to crack & dent after a minor collision. However, the interior of the nail magazine is fitted with a nail-flute sliding channel 17 where all nail sets can be placed. After end face 16 is cracked & dented after collision, it will certainly damage the nail-flute sliding channel 17. As a result, the nail set will be stuck at the damaged spot and fail to reach the working position of muzzle 11. At this moment, this damaged nail magazine 10 becomes useless and must be repaired.

SUMMARY OF THE INVENTION

This invention is to provide a nail magazine having better structural junction strength in order to resist the reaction force generated from construction work. Also, at the proper location, this nail magazine is fitted with structural reinforcement so as to reduce the damage caused by collision. It provides convenience, practical usage and working life. This is the main objective of this invention.

BRIEF DESCRIPTION OF THE DRAWING

For the purpose of better understanding the technical approach and its associated structural characteristics, a series of figures are attached. A brief description of drawing is listed below.

DETAILED DESCRIPTION OF THE PREFERRED EMBODIMENT

Figure 1:
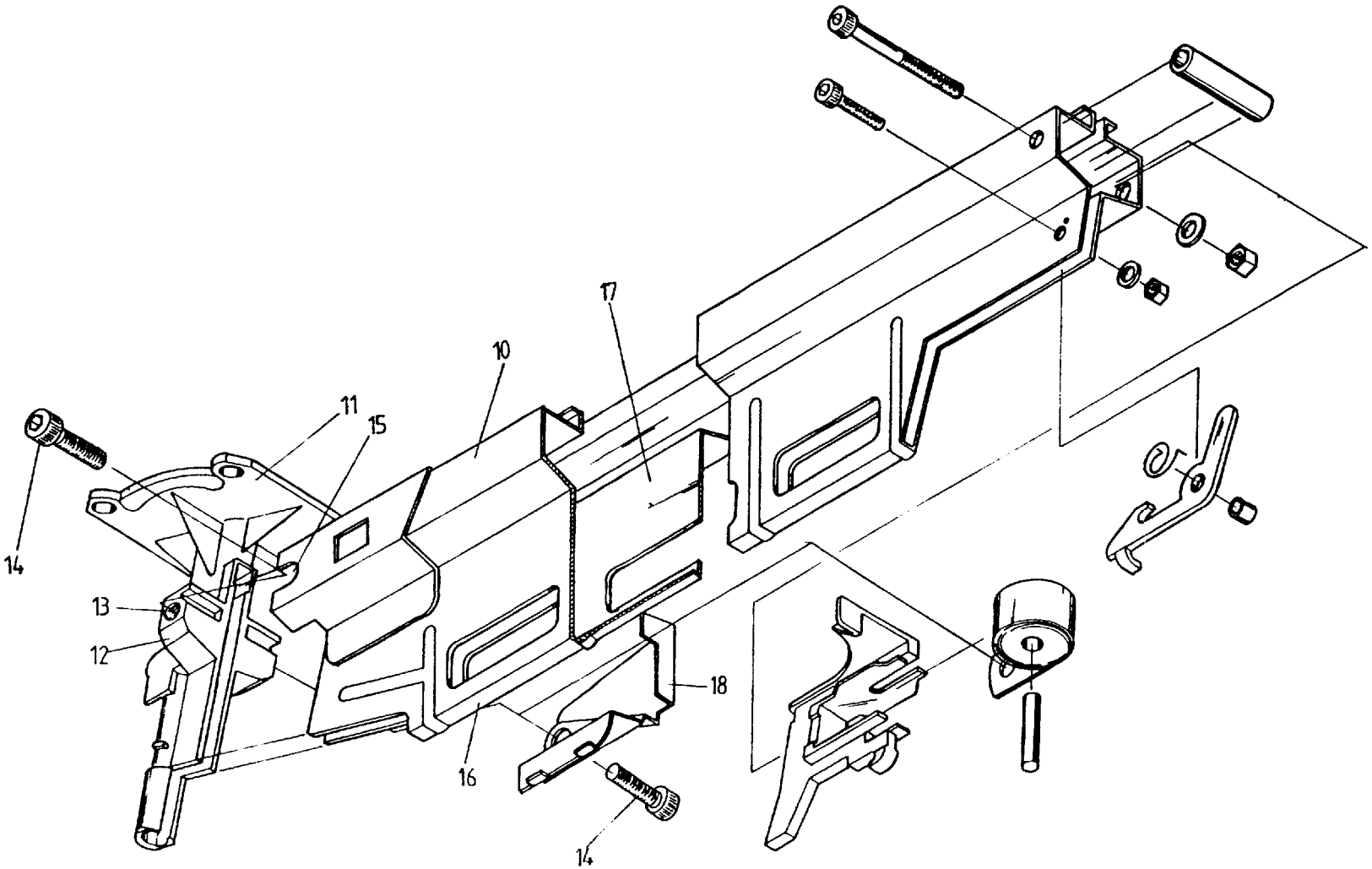
FIG. 1 PRIOR ART
FIG. 1 is an exploded perspective view of a known nail magazine.
Figure 2:
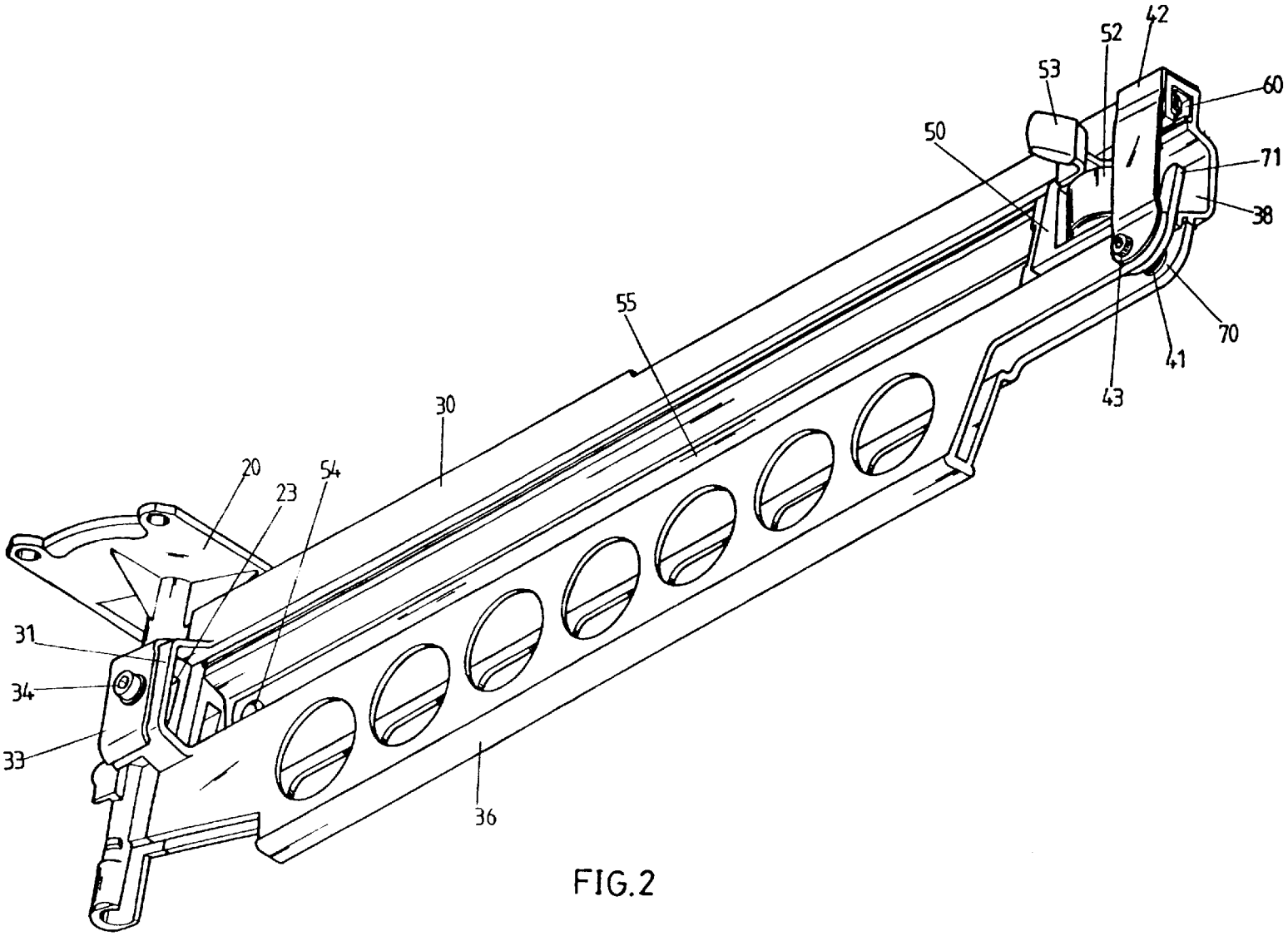
FIG. 2 is a perspective view of a nail magazine according to the present invention.
Figure 3:
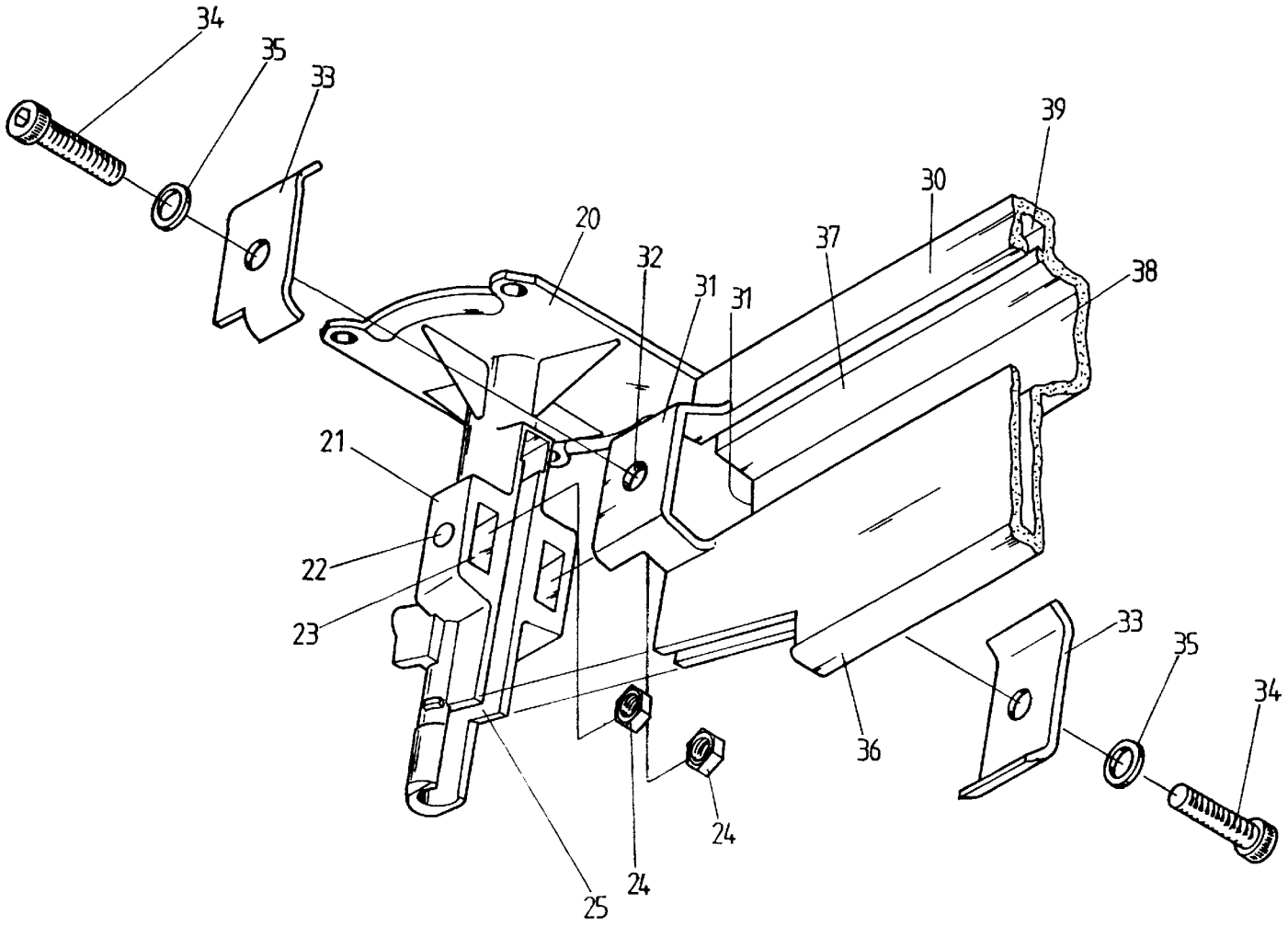
FIG. 3 is a partial, perspective view of the nail magazine of FIG. 2.

Referring to FIG. 2 and FIG. 3, there are protruded fixtures 21 fitted at positions along both sides of muzzle 20 with piercing hole 22 drilled into the end face of fixture 21. A compartment 23 is formed inside the hole to contain a non-slip nut 24. The chamber formed between the two fixtures 21 located on the end face of muzzle's 20 bottom is the nail-firing channel 25. The nail magazine 30 is manufactured by once-through drawing-forming process. An arch shield 31 is fitted to its correspondent fixture 21 where the fixture is correspondent to one side of muzzle 20. It can overlap fixture 21 and fit the fixture to muzzle 20. Also, there is a piercing hole 32 drilled into the end face of arch shield 31. Therefore, the assembly method of muzzle 20 and nail magazine 30 is to place one cap-shaped clip shim 33 outside the up and down arch shield 31 of nail magazine 30 respectively; then use a bolt 34 plus a washer 35 to penetrate through the piercing holes 22 and 32. Afterward, screw them to anti-slip nut 24 inside the compartment 23. These anti-slip nuts 24 will perform their work to provide a better fastening tightness for both parts which is not easy to loosen.

Figure 4:
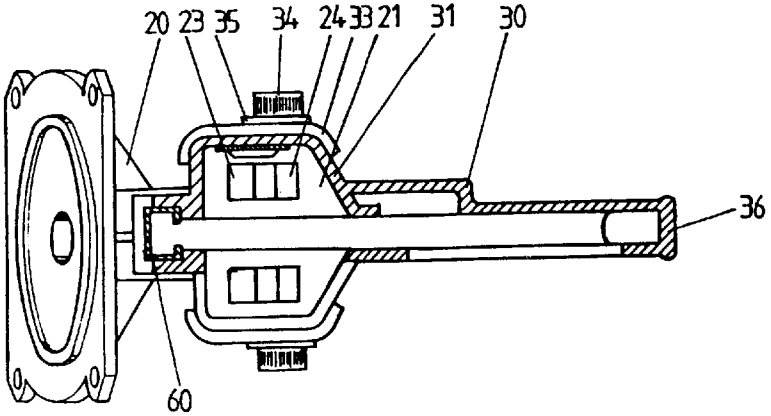
FIG. 4 is a cross-sectional view showing the assembly of the nail magazine and muzzle according to this invention.

Referring to FIG. 2 and FIG. 4, the end face of nail magazine 30 correspondent to work pierce is constructed with a π-shaped configuration reinforcement rib 36 to reinforce its ability to resist deformation.

Figure 5:
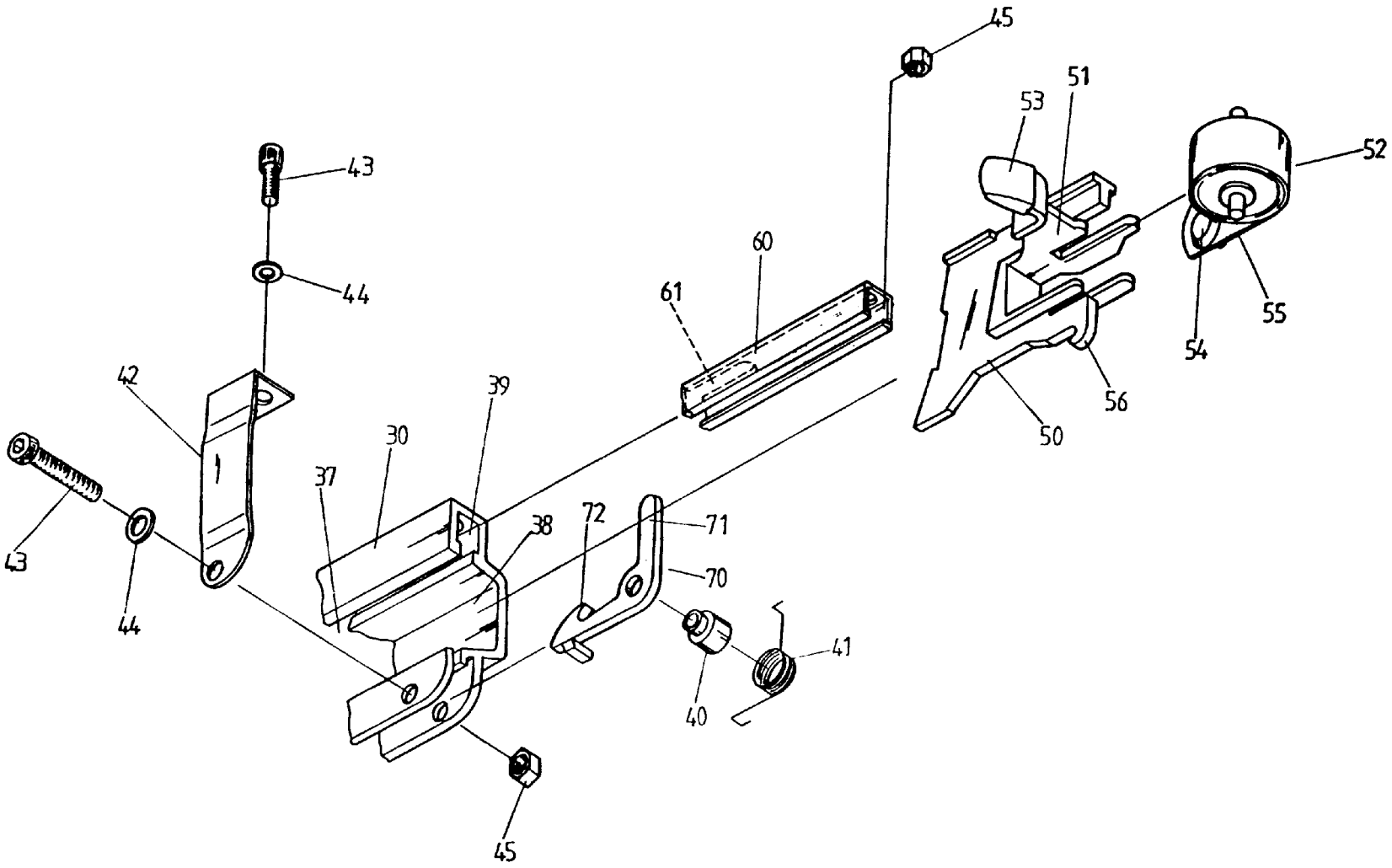
FIG. 5 is an exploded perspective view showing the nail magazine and the nail pushing segment of this invention.

Referring to FIG. 2 and FIG. 5 (please note the position where nail magazine 30 is located and shown on FIG. 5 is the end of nail magazine 30), an open flute 37 is built in the end face of nail magazine 30. A nail pushing segment's sliding channel 38 is located adjacent to the open flute 37. The central interval of nail magazine 30 is the space reserved of nail set and nail pushing segment 50. Furthermore, one side of the nail magazine's interior has a guard plate's insertion slot 39 with an insertion space of anti-wearing guard plate 60 of symmetric shape. Meanwhile, the other side of nail magazine 30 is configured as an open shape where a recoil hook 70 is pivoted by one axle 40, one spring 41 and their relative pivot hole. Recoil hook 70 is firmly secured by positioning clip 42 and two sets of bolt 43, washer 44 and nut 45. It conceals itself in the gap of nail magazine 30 and exposes pushing grip 71 slightly outside the nail magazine 30. There is a compartment 51 located behind the nail pushing segment 50 where the coiled-spring 52 is placed. It has pulling grip 53 installed on its upper end face. The coil 55 is pierced and placed under nail pushing segment 50. They are fixed by rivet joint 54 to the end face of sliding flute 38 and located at a suitable position in the nail magazine 30 front end. Coil 55 of coiled-spring 52 almost contacts flute 38.

Figure 6:
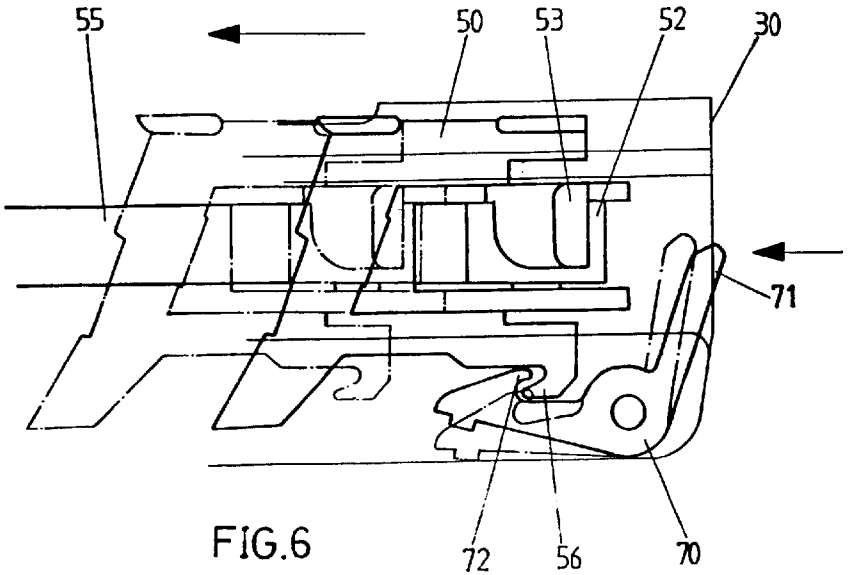
FIG. 6 is a schematic drawing illustrating the functional action of the nail pushing segment and the recoil hook of this invention.

Thus, as shown in FIG. 6, when nail pushing segment 50 is pushed to the end of nail magazine 30, one side of hook part 56 and recoil hook's 70 relative hook part 72 will be hooked together and be positioned. Under this condition, one can use the nail set piercing & loading hole 57 (as shown on FIG. 7) to load the nails. After the completion of nail loading, the grip 71 of recoil hook 70 is pressed to unhook the hook parts 56 and 72. Through the work done by coiled-spring 52, it will pull nail pushing segment 50 back automatically toward muzzle's direction and reach its working position. For the purpose of preventing nail pushing segment 50 from sliding out flute 38 of nail magazine 30, a positioning clip 42 is used to stop it behind the coiled-spring 52.

Figure 7:
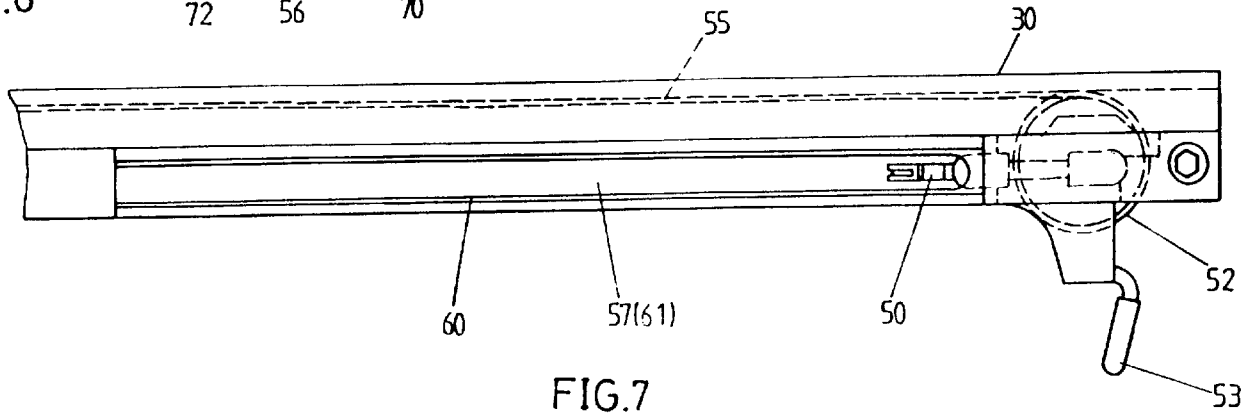
FIG. 7 is a plan view of nail magazine of this invention.

Finally, as shown on FIG. 7, after the completion of the assembly for anti-wearing guard plate 60 and nail magazine 30, the long flute 61 at both sides are correspondent to nail set piercing & loading hole 57 of nail magazine 30. The span width of the long flute 61 is slightly smaller than the span width of nail set piercing & loading hole 57. This can effectively protect nail magazine 30 from wearing. Also, the position of coil 55 is far away from nail set piercing & loading hole 57, therefore, they will not contact each other. The working life of coiled-spring 52 is firmly secured.

After generally and comprehensively reviewing the above-mentioned content, we may conclude that there is no other similar product circulating in the market or no publication & papers reporting the related content before the application submission of this invention. This invention is having its practical value regarding "newly invented" and "progressive" requirements.

What is claimed is:

1. A nailing gun magazine assembly for a big nail set, comprising:

a) a nailing muzzle including a nail firing channel, a fixture protruding from each opposite side of the nailing muzzle and forming a compartment, each fixture having a first hole therethrough in communication with the associated compartment;

b) an anti-slip nut located in each compartment;

c) a nail magazine including a nail sliding channel, a shield member extending outwardly from each of two opposite lateral sides of the nail magazine and located such that, when the nail sliding channel is in communication with the nail firing channel, each shield member overlies one of the fixtures of the nailing muzzle, each shield member having a second hole therethrough aligned with the first hole of the associated fixture;

d) a threaded fastener passing through each of the first and second holes and engaging the associated anti-slip nut so as to attach the nail magazine to the nailing muzzle; and, e) a reinforcing rib extending along a bottom of the nail magazine, the reinforcing rib extending laterally outwardly beyond the two opposite lateral sides of the nail magazine.

2. The nailing gun magazine assembly of claim 1 wherein the nail magazine further includes a top portion and further comprises:

a) an elongated insertion slot formed by the top portion; and, b) an anti-wearing guard plate slidably located in the insertion slot.

3. The nailing gun magazine assembly of claim 2 further comprising a loading hole through the top portion in communication with the elongated insertion slot.

4. The nailing gun magazine assembly of claim 1 further comprising:

a) a nail pushing segment slidably mounted in the nail magazine, the nail pushing segment including a first hook;

b) a coiled spring acting between the nail magazine and the nail pushing segment to bias the nail pushing segment toward the nailing muzzle;

c) a recoil hook member pivotally attached to the nail magazine and including a second hook located so as to releasably engage the first hook to thereby hold the nail pushing segment in a position displaced from the nailing muzzle.

5. The nailing gun magazine assembly of claim 4 wherein an end of the coiled spring is fixedly attached to the nail magazine.

* * * * *